US009366259B2

(12) United States Patent
Binder et al.

(10) Patent No.: US 9,366,259 B2
(45) Date of Patent: Jun. 14, 2016

(54) ELECTRIC FLUID PUMP

(71) Applicant: Mahle International GmbH, Stuttgart (DE)

(72) Inventors: Tobias Binder, Stuttgart (DE); Markus Cramme, Wildberg (DE); Alfred Elsaesser, Keltern (DE); Oliver Fritz, Aichtal (DE); Achim Gommel, Simmozheim (DE); Michael Krappel, Stuttgart (DE); Stephan Weber, Stuttgart (DE)

(73) Assignee: Mahle International GmbH (DE)

( * ) Notice: Subject to any disclaimer, the term of this patent is extended or adjusted under 35 U.S.C. 154(b) by 219 days.

(21) Appl. No.: 14/096,707

(22) Filed: Dec. 4, 2013

(65) Prior Publication Data

US 2014/0161630 A1 Jun. 12, 2014

(30) Foreign Application Priority Data

Dec. 5, 2012 (DE) ..... 10 2012 222 358

(51) Int. Cl.
*F04D 13/06* (2006.01)
*F04D 29/58* (2006.01)

(52) U.S. Cl.
CPC ..... *F04D 13/064* (2013.01); *F04D 29/5813* (2013.01)

(58) Field of Classification Search
CPC ... F04D 13/025; F04D 13/02; F04D 13/0606; F04D 13/0626; F04D 13/064
USPC ..... 417/366, 423.12, 423.14; 310/52, 54, 310/57, 62, 63
See application file for complete search history.

(56) References Cited

U.S. PATENT DOCUMENTS 4,801,252 A * 1/1989 Wrobel ..... H02K 11/0073 384/219
4,808,087 A * 2/1989 Tsutsui ..... F04D 13/064 417/369
4,886,430 A * 12/1989 Veronesi ..... F04D 13/02 310/74
4,992,029 A * 2/1991 Harmsen ..... F04D 29/545 417/354
5,028,218 A * 7/1991 Jensen ..... F04D 13/10 417/366
RE34,456 E * 11/1993 Harmsen ..... F04D 25/0613 417/354

(Continued)

FOREIGN PATENT DOCUMENTS

DE 9308842.6 7/1993
DE 19909371 A1 9/2000

(Continued)

OTHER PUBLICATIONS

Kettner, Thorsten; Translation of DE19909371A1; Sep. 2000.*

(Continued)

*Primary Examiner* — Bryan Lettman
*Assistant Examiner* — David Brandt
(74) *Attorney, Agent, or Firm* — Fishman Stewart PLLC

(57) ABSTRACT

An electric fluid pump may include a wet section having a pump wheel and a permanently excited rotor of an electric motor arranged therein. The electric fluid pump may include a dry section having a stator of the electric motor arranged therein. A containment shell may be included configured to separate the wet section from the dry section. The dry section may include control electronics for controlling the fluid pump. The control electronics may connect in a heat-transferring manner to the containment shell and the wet section via the containment shell.

20 Claims, 3 Drawing Sheets

(56) References Cited

U.S. PATENT DOCUMENTS 5,372,486 A * 12/1994 Wehling ..... F04B 43/1276 417/477.3
5,627,420 A * 5/1997 Rinker ..... F04D 29/628 310/54
5,674,056 A * 10/1997 Yamamoto ..... F04D 13/14 417/366
6,065,946 A * 5/2000 Lathrop ..... F04B 49/065 310/43
6,175,173 B1 * 1/2001 Stephan ..... F04D 29/588 310/87
6,445,098 B1 * 9/2002 Materne ..... F04D 13/0626 310/418
2001/0033800 A1 * 10/2001 Deai ..... F04D 13/0686 417/370
2004/0037719 A1 * 2/2004 Sunaga ..... F04D 29/588 417/423.8
2004/0062664 A1 * 4/2004 Weigold ..... F04D 13/064 417/357
2004/0108779 A1 * 6/2004 Boettger ..... H02K 5/08 310/89
2007/0286723 A1 * 12/2007 Ihle ..... F04D 29/5893 415/206
2007/0286752 A1 * 12/2007 Hanke ..... H02K 3/18 417/423.7
2008/0080975 A1 * 4/2008 Fujii ..... F04D 13/064 415/203
2008/0118380 A1 * 5/2008 Nakanishi ..... F04D 13/064 417/423.1
2008/0185923 A1 * 8/2008 Noe ..... H02K 9/197 310/43
2010/0074777 A1 * 3/2010 Laufer ..... F04D 13/12 417/420
2011/0116948 A1 * 5/2011 Yi ..... H02K 1/148 417/410.1
2012/0014819 A1 * 1/2012 Ishiguro ..... H02K 5/128 417/410.1
2012/0328461 A1 * 12/2012 Lebkuchner ..... F16C 17/02 417/423.13
2013/0058813 A1 * 3/2013 Kim ..... F04D 13/027 417/420
2014/0161630 A1 * 6/2014 Binder ..... F04D 29/5813 417/44.1

FOREIGN PATENT DOCUMENTS

DE 102006021245 A1 10/2007
DE 102007016255 A1 11/2007
DE 102006027001 A1 12/2007
EP 2476914 A1 7/2012

OTHER PUBLICATIONS

English abstract for DE-19909371.
English abstract for DE-102006021245.
English abstract for EP-2476914.

* cited by examiner

ELECTRIC FLUID PUMP

CROSS-REFERENCE TO RELATED APPLICATIONS

This application claims priority to German Patent Application DE 10 2012 222 358.4 filed Dec. 5, 2012, which is hereby incorporated by reference in its entirety.

TECHNICAL FIELD

The present invention relates to an electric fluid pump with a wet section and a dry section according to the preamble of claim 1.

BACKGROUND

From EP 2 476 914 A1 a generic electric fluid pump with a wet section is known, in which a pump wheel and a permanently excited rotor of an electronically commutated electric motor are arranged. The fluid pump additionally comprises a dry section, in which an electric circuit board is arranged. The wet section and the dry section are separated from one another through a separating wall located in a transverse plane and by a containment shell. The electrical circuit board additionally comprises a plurality of power semi-conductors each with a cooling fin, which is arranged on the proximal side of a further circuit board facing the separating wall. The cooling fins in this case are each mounted on a separate printed conductor of the circuit board, wherein the separating wall on its side facing this circuit board comprises an electrically non-conductive thermal foil, which in each case lies on the cooling fin printed conductor. This is to create a fluid pump in which in particular the power semi-conductors are well cooled and the cooling fins of the latter are directly connected to a printed conductor on the circuit board.

The efficiency of modern electric fluid pumps is often limited by their thermal load capacity. Since such fluid pumps are often controlled via control electronics, which in addition are usually also arranged in the housing of the fluid pump where they generate heat, a failure of the fluid pump is the more probable the higher the temperature in the housing about the temperature-sensitive control electronics rises. For this reason, manifold measures are already known from the prior art to cool the dry section, in which the control electronics are usually arranged, thereby lowering the thermal loading for the control electronics and increasing the efficiency of the fluid pump. The cooling measures known from the prior art however are on the one hand elaborate and on the other hand only conditionally effective.

SUMMARY

The present invention therefore deals with the problem of stating an improved embodiment for an electric fluid pump of the generic type which is characterized in particular by an improved thermal management and an increased efficiency.

According to the invention, this problem is solved through the subject of the independent claim. Advantageous embodiments are subject of the dependent claims.

The present invention is based on the general idea of cooling control electronics required for controlling a fluid pump in a manner that is effective and simple in design at the same time through direct connection to a containment shell separating a wet section and a dry section in the fluid pump. The electric fluid pump according to the invention in this case comprises said wet section in which a pump wheel and a permanently excited rotor of an electric motor are arranged. Separated from this by the containment shell is the dry section, in which a stator of the electric motor and the control electronics for controlling the fluid pump are arranged. Through the heat-transferring connection between the control electronics and the containment shell and thus to the wet section it is possible according to the invention to utilise the fluid delivered by the fluid pump, for example coolant, for cooling the control electronics and because of this make possible heat dissipation from the control electronics through the containment shell into the wet section. Through the effective cooling of the control electronics, the efficiency of the pump drive in particular can also be significantly improved, since especially the heat dissipation is a decisive quantity for the efficiency of the pump drive. Through the effective cooling of the control electronics an installation space provided for the latter can also be reduced, as a result of which the fluid pump altogether can be constructed in a more compact manner.

In an advantageous further development of the solution according to the invention, the fluid pump is designed as a coolant pump. In particular in the case of a fluid pump designed as a coolant pump which is preferably installed in motor vehicles, a compact design because of ever diminishing installation space available in the region of an engine compartment is a major advantage. Through the more compact design, weight can be additionally saved, which is likewise a major advantage in motor vehicles.

Practically, the containment shell is formed of metal at least in the region of the heat-transferring connection of the control electronics or entirely, wherein it is alternatively also conceivable that the containment shell is formed of plastic, in which particles with a particularly good heat conductivity, in particular metal particles, graphite or ceramic are embedded for improved heat conduction. The particles advantageously have a better heat conductivity than the plastic material in which these are embedded. When using ceramic particles such as for example boron nitride not only a good heat conductivity can be achieved, but also that through the particles, current that may be conducted through the wall is avoided since such particles are electrically insulating. In order to be able to bring about as high as possible a heat dissipation from the control electronics through the containment shell into the wet section it is required that the containment shell in the connecting region of the control electronics possesses a good heat transfer, i.e. a high heat conductivity and a low thermal resistance. Metals and in particular aluminium in this case have an excellent heat conductivity, which make possible a high rate of heat dissipation from the control electronics through the containment shell into the wet section and thus a heat transfer to the coolant. Forming the containment shell entirely of metal brings about an optimised heat transfer from the dry section and the wet section and thereby also optimal cooling of the control electronics. Obviously, a more cost-effective design of plastic compared with a design of metal is also conceivable, wherein particles which have good heat conductivity, in particular metal particles, graphite or ceramic can be embedded in this plastic for improved heat conductivity. Again alternatively to this it is conceivable that the containment shell, for example in the region of a cover disc, is merely partially formed of metal, so that the containment shell as a whole can be considered as a composite component consisting of plastic cylinder and metal cover disc. This would be a compromise between on the one hand cost-effective production and on the other hand improved heat dissipation.

Practically, the containment shell in the connecting region to the control electronics has the previously mentioned metal insert part, about which or onto which the remaining containment shell of plastic is injection moulded. Alternatively, the containment shell can also be formed as a tubular plastic cylinder, i.e. generally as a plastic tube, the one end of which is closed off by a metal cover disc. The control electronics in turn would be connected to this metal cover disc in a heat-transferring manner. The individual embodiment of the containment shell and the respective selected heat-transferring connection of the control electronics in this case can be individually orientated or adapted to a wide range of versions of individual fluid pumps.

In a further advantageous embodiment of the solution according to the invention, the containment shell comprises a point of support for mounting the rotor of the electric motor. The point of support in this case can be arranged on an axial wall of a cylindrical containment shell, wherein the containment shell is optionally in one piece or composed of a plurality of components. In a one-piece design of the containment shell, stamping a suitable point of support onto a shell bottom of the containment shell for example during the production of the latter is conceivable. If the containment shell by contrast is designed as a composite part, it is also conceivable that the point of support is held via at least two radial webs on a tubular plastic cylinder, the one end of which is engaged about and closed off by a metal cover disc. In this case, the plastic cylinder can thus be formed together with the two radial webs holding the point of support as a cost-effective plastic injection moulding and merely be closed off by the cup-like metal cover disc. Alternatively it is obviously also conceivable that the point of support is arranged in the metal cover disc and the latter is simply pushed onto the plastic tube forming the remaining containment shell at a longitudinal end. With all containment shells joined together of a plurality of parts it must be ensured that a suitable sealing between the individual parts takes place in order to effectively prevent an undesirable liquid passage from the wet section into the dry section and because of this for example damaging of the control electronics.

Further important features and advantages of the invention are obtained from the subclaims, from the drawings and from the associated figure description by means of the drawings.

It is to be understood that the features mentioned above and still to be explained in the following cannot only be used in the respective combination stated but also in other combinations or by themselves without leaving the scope of the present invention.

BRIEF DESCRIPTION OF THE DRAWINGS

Preferred exemplary embodiments of the invention are shown in the drawings and are explained in more detail in the following description, wherein same reference characters relate to same or similar or functionally same components.

Here it shows, in each case schematically.

DETAILED DESCRIPTION

Figure 1:
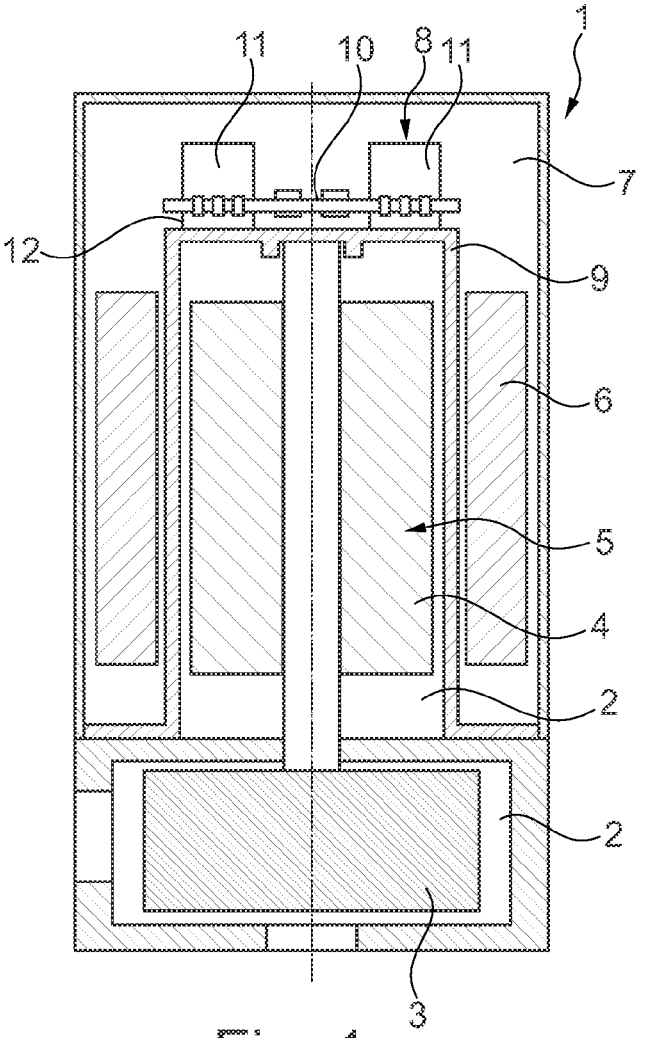
FIG. 1 a sectional representation through a fluid pump according to the invention, with control electronics connected to a containment shell in a heat-transferring manner, FIG. 2 a detail representation of the heat-transferring connection between control containment shell and control electronics in another embodiment, FIGS. 3 to 5 each a representation as in FIG. 2, however with different embodiments, FIG. 6 a sectional representation through a containment shell with point of support held via radial webs and metal cover disc.

According to FIG. 1, an electric fluid pump 1, which in particular can be designed as a coolant pump and be arranged in a motor vehicle, comprises a wet section 2, in which a pump wheel 3 and a permanently excited rotor 4 of an electric motor 5 are arranged. A stator 6 of the electric motor 5 by contrast is arranged in a dry section 7, just as control electronics 8 for controlling the electric motor 5. A fluid-tight separation between the dry section 7 and the wet section 2 is effected via a containment shell 9. According to the invention, the control electronics 8 are now arranged in the dry section 2 of the fluid pump 1, which in addition is connected to the containment shell 9 in a heat-transferring manner and because of this to the wet section 2 and the coolant or fluid flowing therein. Through the heat-transferring connection of the control electronics 8 to the containment shell 9 a rapid heat dissipation and thus effective cooling of the control electronics 8 can be achieved, which, in particular for the efficiency of the fluid pump 1, is a decisive advantage. In addition, the dry section 7 of the fluid pump 1 according to the invention and in this case in particular the space directly surrounding the control electronics 8 can be kept smaller since the control electronics 8 are better cooled through the heat-transferring connection to the containment shell 9 so that the fluid pump 1 according to the invention can be altogether more compactly constructed and thus designed in an installation space-optimised manner.

In the shown embodiments, the control electronics 8 comprise a circuit board 10, on which at least two power semi-conductors 11 are mounted. The power semi-conductors 11 in this case are arranged on a side of the circuit board 10 facing away from nthe containment shell 9. The circuit board 10 is connected on its side facing the containment shell 9 to the containment shell 9 via thermally conductive platelets 12, wherein the platelets 12 are connected through the circuit board 10 to the power semi-conductors 11 in a heat-transferring manner, for example via so-called "'thermal vias ' 13". The term "thermal vias" usually stands for thermal conductors generally.

The individually possible embodiments of the heat-transferring connection of the control electronics 8 to the containment shell 9 in this case are shown in FIGS. 2 to 6.

Figure 2:
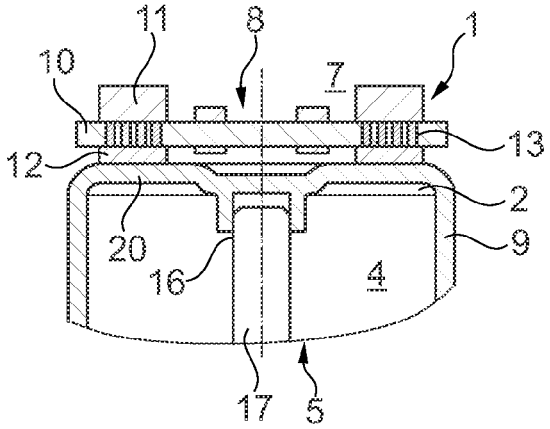

FIG. 2 in this case shows a first possible embodiment of the thermal connection of the control electronics 8 to the containment shell 9. In this example, the containment shell 9 is preferentially entirely formed of metal and because of this highly heat-conductive, so that the control electronics 8 via the platelets 12 can dissipate a lot of heat to the containment shell 9 and thus to the coolant flowing in the web section 2. Obviously, the containment shell 9 can also be formed of metal merely in the region of the heat-transferring connection of the control electronics 8 but for the remainder be formed of plastic. In order to be able to at least slightly improve the thermal conductivity of the containment shell 9 formed of plastic, metal particles 20 can be embedded in the plastic of the containment shell 9.

Figure 3:
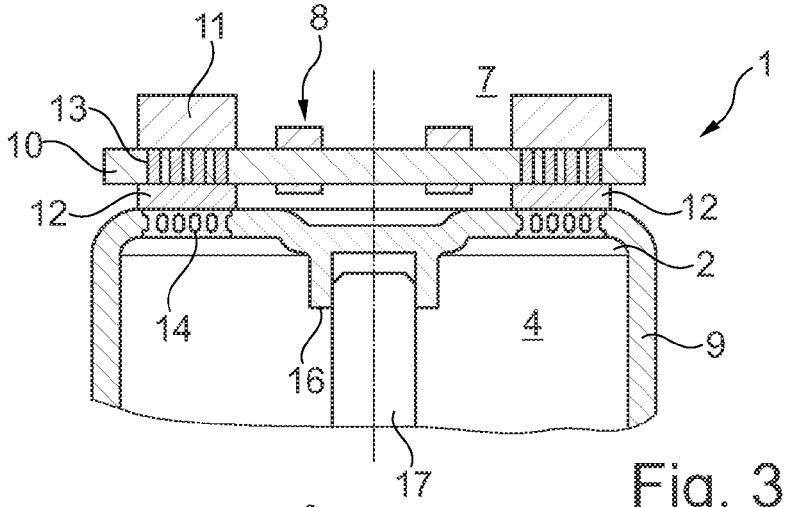

Considering FIG. 3 it is evident that in the region of the thermal connection of the control electronics 8 to the containment shell 9 a metal insert part 14 is embedded in the plastic of the containment shell 9. In this case, the containment shell 9 is thus formed as a composite part of plastic and metal.

Figure 4:
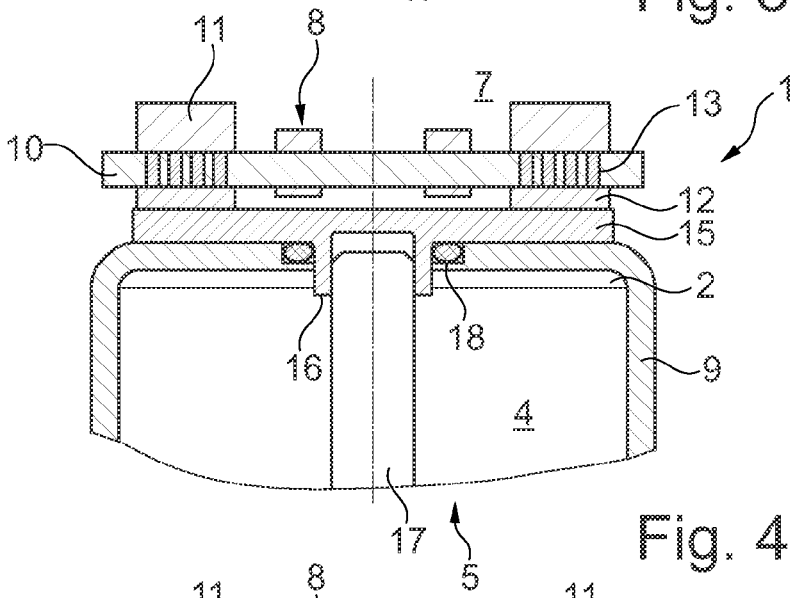

In the embodiment according to FIG. 4, an additional cover disc 15 is arranged between the platelets 12 of the control electronics 8 and the containment shell 9, which has a comparatively large heat transfer area to the containment shell 9 and because of this likewise ensures high heat dissipation. On the additional cover disc 15, a point of support 16 is formed at the same time, in which a shaft 17 of the rotor 4 is mounted. In the previously shown embodiments of the fluid pump 1, such a point of support 16 is directly formed on the containment shell 9. Obviously, a break-through in the containment shell 9, through which the point of support 16 of the additional cover disc 15 projects is sealed by means of a seal 18, so that in this case a complete separation between the wet section 2 and the dry section 8 can be maintained also in this case.

Figure 5:
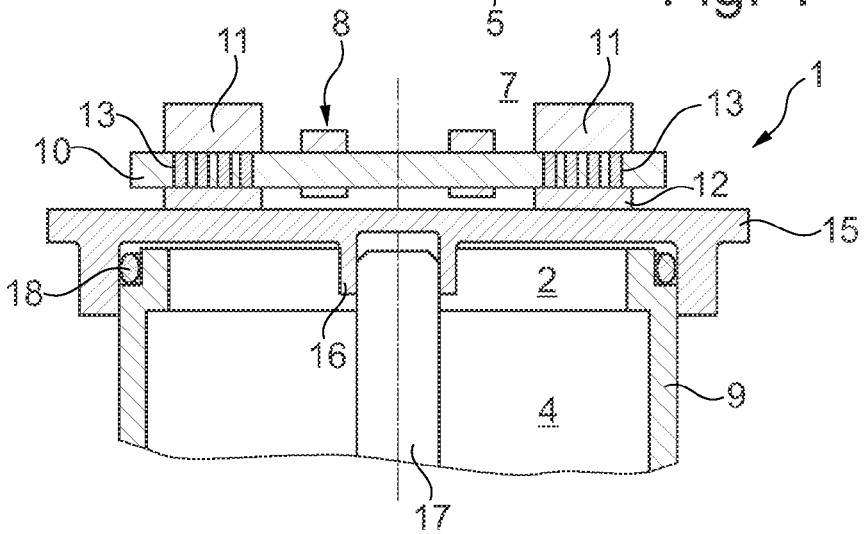

Considering the embodiment according to FIG. 5 it is evident that the containment shell 9 is formed as a tubular plastic cylinder, the one end of which is engaged about and sealingly closed off by a metal cover disc 15. The point of support 16 in this case, as also in FIG. 4, is likewise arranged in the cover disc 15. By way of seal 18, the cover disc 15 is sealed off relative to the tubular containment shell 9. The embodiment shown in FIG. 5 offers the major advantage of a comparatively large metal heat transfer area and because of this good heat dissipation.

Figure 6:
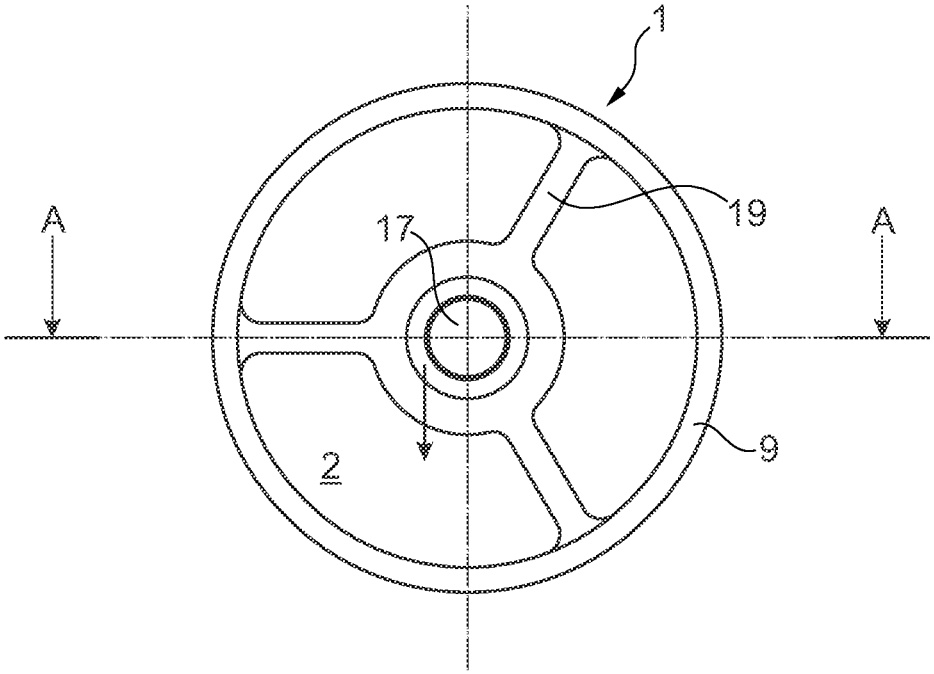
Figure 6:
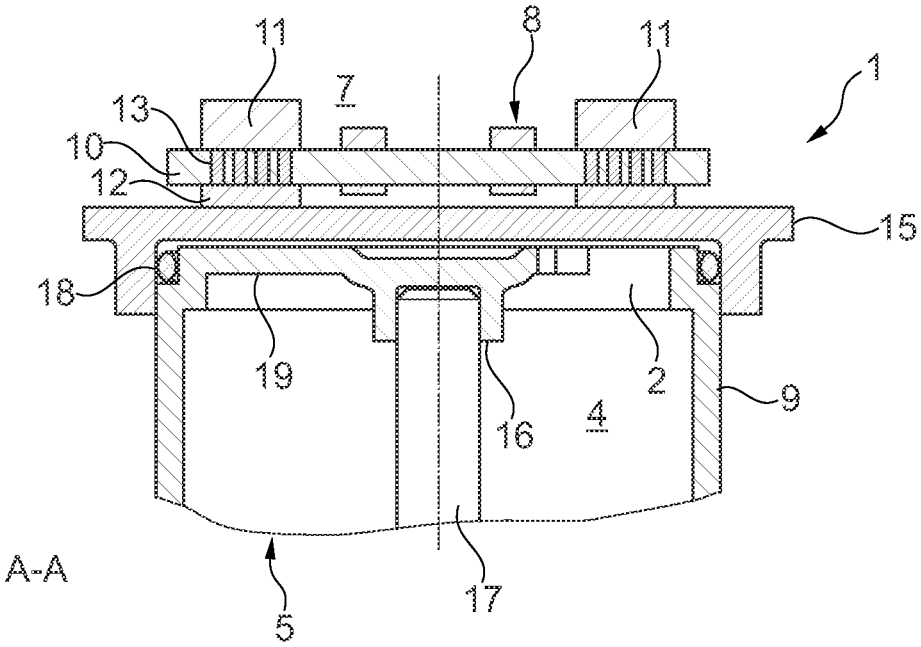

According to FIG. 6, a tubular containment shell 9 which is preferentially likewise formed of plastic is shown, in which however the point of support 16 is held on the tubular plastic cylinder of the containment shell 9 via at least two webs 19. The neighbouring axial longitudinal end of the plastic cylinder in this case is likewise engaged about and closed off by a metal cover disc 15, wherein the metal cover disc 15 in the shown exemplary embodiment now no longer comprises a point of support 16. Sealing between the tubular plastic cylinder and the cover disc 15 in this case is likewise effected by means of known seals 18, for example O-ring seals.

All shown embodiments in this case have in common that the control electronics 8 are connected to the containment shell 9 in a heat-transferring and thus favourably heat-dissipating manner and in addition to this to the wet section 2 of the fluid pump 1, as a result of which the cooling of the control electronics 8 is significantly improved. Through the improved cooling of the control electronics 8 the efficiency of the same can be significantly improved. Through the improved cooling, the dry section 2 and here in particular the space surrounding the control electronics 8 can be additionally reduced as a result of which a greater performance density and a compact design can be achieved.

In a composite design of plastic and metal, the containment shell 9 according to the invention cannot only bring about the improved heat transfer but at the same time also be produced in a high-quality and cost-effective manner If the point of support 16 is arranged in a part formed of metal, for example the cover disc 15 or the containment shell 9, a higher strength and load capacity of the fluid pump 1 can be additionally achieved.

The invention claimed is:

1. An electric fluid pump, comprising:

a wet section having a pump wheel and a permanently excited rotor of an electric motor arranged therein;

a dry section having a stator of the electric motor arranged therein; and a containment shell configured to separate the wet section from the dry section;

wherein the dry section includes control electronics for controlling the fluid pump, the control electronics connected in a heat-transferring connection to the containment shell and the wet section via the containment shell; and wherein at least one of:

the containment shell includes a metal insert part disposed in a region of the heat-transferring connection, wherein the metal insert part is embedded in a material of the containment shell, the metal insert part in heat conducting contact with the control electronics and the wet section, and wherein the metal insert part has a greater thermal conductivity than the material of the containment shell disposed away from the heat-transferring connection; and the containment shell is configured as a tubular cylinder, wherein an end of the tubular cylinder is closed off by a cover disc disposed in a region of the heat-transferring connection, and wherein the cover disc is composed of a plastic having particles embedded therein, wherein the particles have a greater thermal conductivity than the plastic.

2. The fluid pump according to claim 1, wherein the fluid pump is configured as a coolant pump.

3. The fluid pump according to claim 1, wherein at least one of the containment shell includes a metal, and the containment shell is composed of a plastic including particles embedded therein, the particles having a greater thermal conductivity than that of the plastic of the containment shell for improved heat conduction.

4. The fluid pump according to claim 1, wherein the control electronics comprise a circuit board having at least two power semi-conductors mounted thereon, and wherein the at least two power semi-conductors are arranged on a side of the circuit board facing away from the containment shell.

5. The fluid pump according to claim 4, wherein the circuit board is connected to the containment shell via thermally conductive platelets disposed at the heat-transferring connection, and wherein the platelets are connected in a heat-transferring manner to the at least two power semi-conductors through the circuit board via thermal conductors.

6. The fluid pump according to claim 1, wherein the containment shell includes the metal insert part, and the material of the containment shell comprises a plastic, wherein the metal insert part is embedded in the plastic of the containment shell.

7. The fluid pump according to claim 1, wherein the containment shell configured as the tubular cylinder is composed of a plastic, and wherein at least one of:

the cover disc comprises a metal, and the cover disc comprises a plastic.

8. The fluid pump according to claim 1, wherein the containment shell includes a point of support for mounting at least one of the rotor and a shaft of the electric motor.

9. The fluid pump according to claim 8, wherein the point of support is arranged in the cover disc.

10. The fluid pump according to claim 3, wherein the control electronics includes a circuit board having at least two power semi-conductors mounted thereon, and wherein the at least two power semi-conductors are arranged on a side of the circuit board facing away from the containment shell.

11. The fluid pump according to claim 10, wherein the circuit board connects to the containment shell via thermally conductive platelets disposed at the heat-transferring connection, wherein the platelets are connected in a heat-transferring manner to the at least two power semi-conductors through the circuit board via thermal conductors.

12. The fluid pump according to claim 1, wherein the containment shell configured as the tubular cylinder is composed of a plastic.

13. The fluid pump according to claim 12, wherein the cover disc is comprised of plastic, and wherein the cover disc has a wall thickness thinner than a wall thickness of the containment shell.

14. The fluid pump according to claim 12, wherein the cover disc is composed of the plastic including particles embedded therein, wherein the particles have better thermal conductivity than the plastic.

15. The fluid pump according to claim 5, wherein the containment shell includes a plurality of metal insert parts each in heat conducting contact with at least one of the thermally conductive platelets.

16. The fluid pump according to claim 1, wherein the containment shell configured as the tubular cylinder includes the cover disc composed of the plastic having particles embedded therein, and wherein the particles include ceramic particles.

17. The fluid pump according to claim 16, wherein the ceramic particles include boron nitride.

18. The fluid pump according to claim 1, wherein the containment shell is composed of a plastic including particles embedded therein, and wherein the particles include ceramic particles.

19. The fluid pump according to claim 9, further comprising a sealing element engaging the point of support of the cover disc, wherein the sealing element is disposed between the cover disc and the containment shell.

20. An electric fluid pump, comprising:

a wet section having a pump wheel and a permanently excited rotor of an electric motor arranged therein;

a dry section having a stator of the electric motor arranged therein; and a containment shell configured to separate the wet section from the dry section;

wherein the dry section includes control electronics for controlling the fluid pump, the control electronics connected in a heat-transferring manner to the containment shell and the wet section via the containment shell;

wherein the containment shell is configured as a tubular plastic cylinder and includes a point of support for mounting at least one of the rotor and a shaft of the electric motor, the point of support being held via at least one web on the tubular plastic cylinder, and wherein an end of the tubular plastic cylinder including the at least one web is engaged about and closed off by a metal cover disc.

* * * * *